US011020649B2

(12) United States Patent
Sims

(10) Patent No.: US 11,020,649 B2
(45) Date of Patent: Jun. 1, 2021

(54) GRIPPING GLOVE

(71) Applicant: Antjuane Sims, Los Angeles, CA (US)

(72) Inventor: Antjuane Sims, Los Angeles, CA (US)

( * ) Notice: Subject to any disclaimer, the term of this patent is extended or adjusted under 35 U.S.C. 154(b) by 43 days.

(21) Appl. No.: 15/449,824

(22) Filed: Mar. 3, 2017

(65) Prior Publication Data

US 2018/0250578 A1 Sep. 6, 2018

(51) Int. Cl.
*A63B 71/14* (2006.01)

(52) U.S. Cl.
CPC ..... *A63B 71/14* (2013.01); *A63B 71/146* (2013.01); *A63B 2209/10* (2013.01); *A63B 2244/09* (2013.01)

(58) Field of Classification Search
CPC .... A63B 71/14; A63B 71/148; A41D 13/081; A41D 13/082; A41D 13/01547; F41B 5/1473
USPC ..... 2/16, 20, 21, 163, 161.1, 161.6, 162; D29/113, 114, 115, 116.1, 116.2, 116.3, D29/117.1, 117.2
See application file for complete search history.

(56) References Cited

U.S. PATENT DOCUMENTS 2,985,885 A * 5/1961 Layer ..... F41B 5/1473 2/161.5
3,168,749 A * 2/1965 Cala ..... A41D 1/06 2/211
3,880,426 A * 4/1975 Morse ..... A63D 5/00 473/61
4,361,912 A * 12/1982 Arthur ..... A63B 69/004 2/18
4,400,831 A * 8/1983 Rietz ..... A63B 71/14 2/161.1
4,777,666 A * 10/1988 Beverlin ..... F41B 5/1473 124/88
5,970,521 A * 10/1999 Rabbeth ..... A63B 71/148 2/16
6,834,397 B1 * 12/2004 Murphy ..... A63B 69/0066 2/161.1
D634,481 S * 3/2011 Davis ..... D29/117.1
9,380,817 B1 * 7/2016 Drake ..... A41D 13/082
9,643,073 B1 5/2017 Pellegrino
2016/0038822 A1 * 2/2016 Zinder ..... A63B 71/141 2/21
2017/0348584 A1 * 12/2017 Rhodes ..... A41D 13/0562

OTHER PUBLICATIONS

Bear Grips—Grips for Weightlifting & More, accessed Sep. 22, 2020, 1 page, https://www.beargrips.com/collections/workout-grips.
Victory Grips—Find Your Grips, accessed Sep. 22, 2020, 1 page, https://victorygrips.com/pages/find-your-grips.
Walsh J. "Two Finger Bowling Explained, and Tips on Hooking the Ball" *Beginner Bowling Tips*, Jan. 2012, 1 page, https://beginnerbowlingtips.com/two-finger-bowling-explained-and-tips-on-hooking-the-ball.

* cited by examiner

*Primary Examiner* — Khoa D Huynh
*Assistant Examiner* — Aiying Zhao
(74) *Attorney, Agent, or Firm* — Steinfl + Bruno, LLP

(57) ABSTRACT

A gripping apparatus is disclosed. A gripping glove comprises a wrist band which can be secured with hook and loop fastener patches, and a palm strip with finger loops. The palm strip may be divided into three different strips and allows a comfortable grip during sport activities.

22 Claims, 4 Drawing Sheets

GRIPPING GLOVE

TECHNICAL FIELD

The present disclosure relates to sport equipment. More particularly, it relates to gripping gloves.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

SUMMARY

In a first aspect of the disclosure, a gripping glove is described, the gripping glove comprising: a wrist band having a first end, a central portion, and a second end, the first end comprising a loop fastener patch and the second end having a hook fastener patch, wherein the wrist band is configured to wrap around a wrist and secure itself through the hook and loop fastener patches; a first palm strip, having a first end and a second end, the first end being attached to the wrist band; a second palm strip, having a first end and a second end, the first end being attached to the wrist band; a third palm strip, having a first end and a second end, the first end being attached to the wrist band; a first finger loop, attached to the second end of the first palm strip; a second finger loop, attached to the second end of the second palm strip; and a third finger loop, attached to the second end of the third palm strip.

DETAILED DESCRIPTION

The present disclosure relates generally to gripping gloves for improving the grip of users while engaging in various sporting activities such as weightlifting and golfing, or any activity that requires the user to grip, grab, pull, lift, push, or swing a tubular object, such as rowing or bat swinging, for example in baseball. More particularly the gloves can help to reduce the formation of calloused hands while a secure grip for users who participate in cross-training workouts and competitions.

CrossFit®'s global popularity has attracted participants from all over the world which has made it a highly competitive, internationally popular, strength and conditioning program. The CrossFit® participants' transition through various high intensity exercises ranging from gymnastics movements to Olympic weightlifting, both of which accelerate muscle fatigue in the hands, wrists, and forearms which leads to a decrease in secured grip. A loss of grip strength affects athletic performance. A decrease in grip strength and calloused hands are problems that are commonly experienced when participating in CrossFit®. The problem is so pervasive that taping of the hands is practiced in an attempt to minimize the problem. Weightlifters and golfers also experience both calloused hands and a decrease in grip strength as a result of muscle fatigue in the hands and forearms.

The present disclosure describes a grip apparatus for the user that improves gripping tubular shaped object(s). The grip apparatus can reduce the development of calloused hands, as well as reduce friction between the hands of the user and the tubular shaped object(s) and provide wrist support when wearing the grip apparatus. The grip apparatus can also be durable and easy to remove if necessary when a user is engaged in athletic activities.

Figure 1:
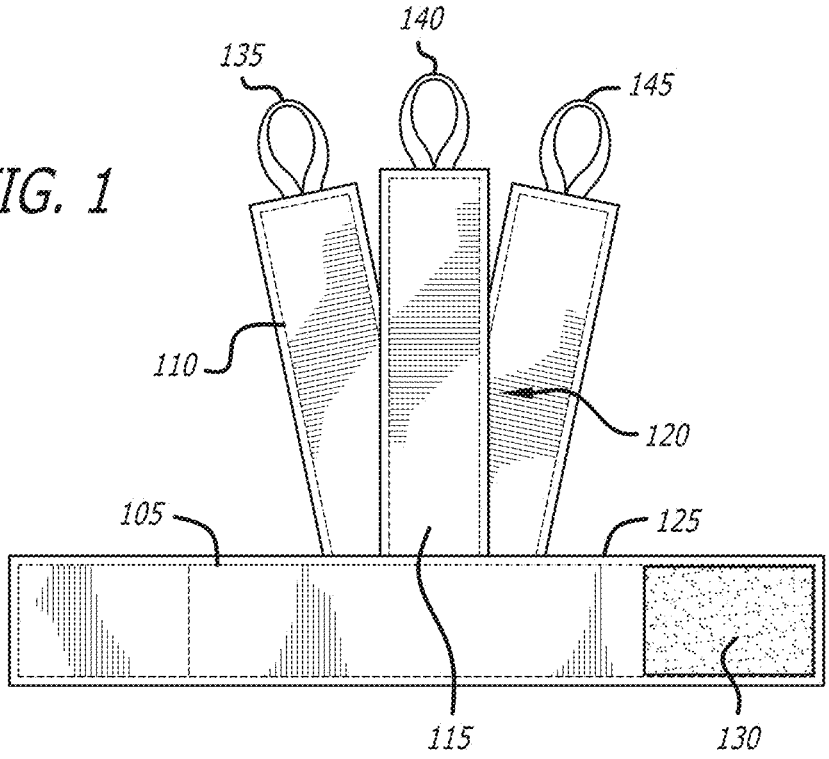
FIG. 1 illustrates an exemplary view of the front side of the glove grip strips with open wristband.

In reference to FIG. 1, there is shown a grip apparatus with four separate strips (105, 110, 115, 120) all individually sewn together. The view shown is for the open front of the glove. Three strips of similar measurement (110, 115, 120) forms the palm for gripping tubular object(s), and one strip (105) forms the wristband for wrist support. Each of the three strips (110, 115, 120) aligns with each of the first three individual fingers of the hand of a user, starting from the index finger. Using three strips (110, 115, 120) for the palm area and allowing airflow to pass through all sides of the strips (110, 115, 120), allows for a natural experience for the user when gripping tubular object(s). The three palm strips (110, 115, 120) conform to the shape and movement of the hand and fingers when gripping tubular object(s). The formation of the three palm strips (110, 115, 120) allows the hand and fingers to move about freely, following the shape of the hand and the natural movement of the fingers when gripping, grabbing, pulling, lifting, pushing, or swinging tubular object(s). The material used for the grip apparatus in protecting the palm and calluses may be made with non-slip material, such as split grain leather, nylon, polyvinyl chloride (pvc), polyurethane (pu) or similar materials, to reduce friction between the user's hand and the tubular object(s).

The palm protection strips (110, 115, 120) extend from the base of the palm to the first knuckle of the first three fingers; index, middle, and ring fingers. These three palm strips (110, 115, 120) cover the calloused areas of the palm where grip strength is most significant. Attached at the top of the three individual palm strips (110, 115, 120) are finger loops (135, 140, 145) made of a stretchy material that slide down past the second knuckle of each finger to hold the material against the palm. A user inserts the index finger, middle finger, and ring finger into the loops (135, 140, 145) that are individually sewn horizontally, but extend vertically past the top of each strip (110, 115, 120) by one inch, more or less. The loops (135, 140, 145) then fold in themselves and sewn into each strip (110, 115, 120). In addition, the loops (135, 140, 145) can be individually sewn horizontally and extend horizontally in the same line as the top of each individual strip (110, 115, 120). In some embodiments, the strips have stiches on the edges, as shown in FIG. 1, on the surface meant to contact the object to be gripped. The material will fold and join on the other side, where it can be stitched in the middle of the strip. In some embodiments, both sides may be stitched on the edge of the material, closely along each side of the middle line. In other embodiments, the folded material may be glued. In some embodiments, the strips are therefore formed of a single strip of material that is folded in order to have both edges meet around the middle of a surface.

In some embodiments, the material used may have a texture, such as a ribbed texture. For example, small dots or circles may form a texture on the surface, to create a better grip. For example, the texture may be made by embossing, so that the dots rise on the surface forming a relief. In some embodiments, the surface meant to contact the object to be gripped may have no stitching, with the material simply folded and stitched around the middle on the other side. Alternatively, the material may be glued, or stitched as well as glued. In some embodiments, some stitching may be visible on the surface meant to contact the object to be gripped, limited to the area at the extremal tip of the strip, where the finger loops are located. This stitching allows the finger loops to be securely attached to the strips. In some embodiments, the finger loops may extend longitudinally along the strip, as in FIG. 1. In other embodiments, the finger loops may instead extend away from the surface meant to contact the hand, as shown in subsequent Figures. Some exemplary embodiments are shown also in subsequent Figures herein.

In some embodiments, the strip of material meant to wrap around the wrist is long enough to wrap around the wrist more than once. For example, the strip may be long enough to wrap one and a half times, to allow a secure grip on the wrist. The half turn allows the Velcro®™ attachments to secure at the top side of the wrist. In some embodiments, a brand or logo patch may be attached at this location. In other embodiments, a Velcro® patch may be attached at this position and left empty, for the user to customize with their own Velcro® logo.

In some embodiments, the gripping glove may be provided in different sizes, such as small, medium and large. However, in other embodiments the three palm strips may be adjusted by the user in order to provide the glove in a single, adjustable size. For example, the palm strips may be joined together but not stitched to the wrist strap. The three palm strips may be attached to the wrist strap by a Velcro® patch. The user could detach the palm strips from the wrist strap, and subsequently move the three palm strips up or down, perpendicularly to the wrist strap, in order to shorten or lengthen the length of the finger straps extending from the wrist strap. In such a way, the glove can be adjusted for users having longer or shorter fingers.

In some embodiments, the wrist strap may be placed centrally with respect to the palm strips, so that it can be wrapped from both sides. In other embodiments, one end of the wrist strap may be attached to the palm strips, so that it is only the opposite end of the wrist strap that wraps around the wrist. The wrist strap may be, in any case, positioned in different ways with regard to the palm strips.

Fingers can be easily removed from the loops (135, 140, 145) after using the grip apparatus. Of the three palm strips (110, 115, 120), the middle strip (115) can be sewn vertically and is anterior to the two strips (110, 120) on either side that angle outward from the base of the palm. The two posterior strips (110, 120) can reinforce the grip of the middle strip (115), as well as reduce the amount of friction between tubular object(s) and the hand.

All three strips (110, 115, 120) converge at the base of the palm and are sewn to the horizontal wristband strip (105), which can also be made of a stretchy material such as neoprene. In addition to using non-slip material and/or neoprene for the wristband (105), stitching foam padding on the inside of the wristband strip (105), or the like, is possible. Thread stitching (125) outlines the borders of each of the four strips (105, 110, 115, 120). Velcro® material (130) can be sewn onto both ends of the wristband strip (105) in order to connect the ends when the wristband (105) is closed. Velcro® can be substituted with any other hook and loop fastener material as understood by the persons skilled in the art. As shown in FIG. 1, the rough side of the Velcro® material (130) is exposed. In addition, the wristband strip (105) could be made wider to boost wrist support.

Figure 2:
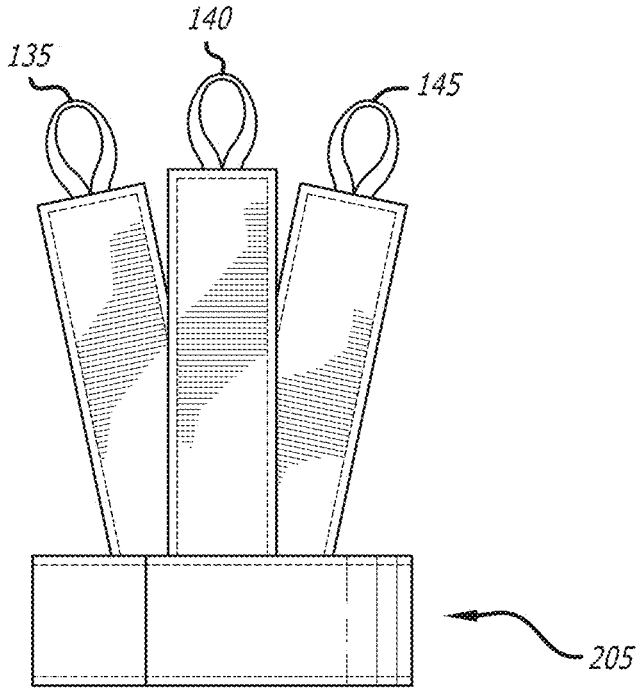
FIG. 2 illustrates an exemplary front side of the glove grip strips with closed wristband.

FIG. 2 shows an exemplary front view of the wristband (205) of the grip apparatus in its closed position. The view shown is for the closed front of the glove.

Figure 3:
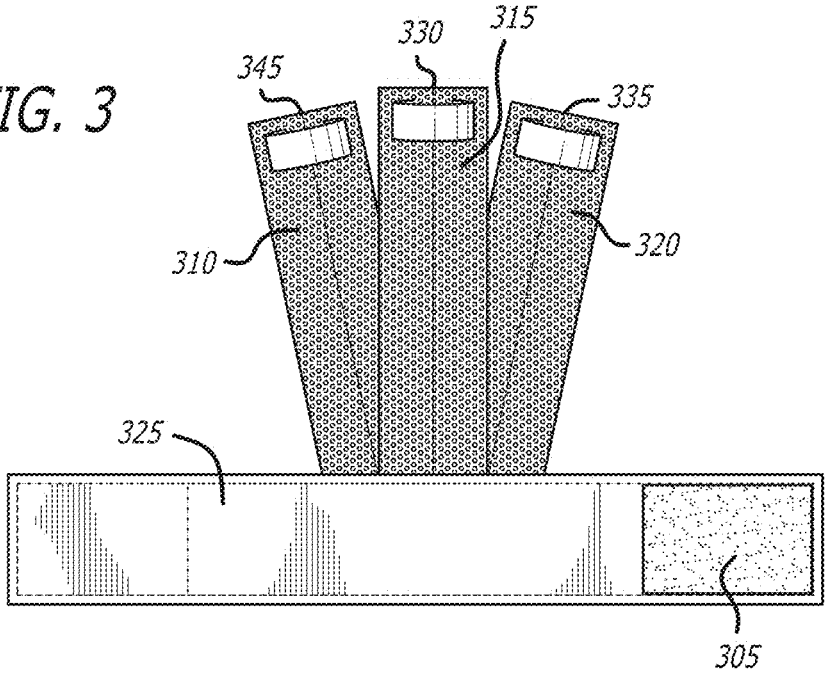
FIG. 3 represents an exemplary back side of the glove grip strips with open wristband.

In FIG. 3, an exemplary grip apparatus is shown from a back view with the soft material of the Velcro® (305) exposed. The view shown is for the open back of the glove. The three palm strips (310, 315, 320) converge at the base of the palm and are stitched or otherwise attached to the wristband strip (325). The left and right strips (310, 320) are now anterior to the middle strip (315). The finger loops (330, 335, 345), made of stretchy material, are at the top of each strip (310, 315, 320) and can be stitched onto the material horizontally. Each individually stitched loop (330, 335, 345) provides the wearer ease of use and conformity when gripping tubular object(s). The finger loops (330, 335, 345) extend laterally with regard to the strips (310, 315, 320). This embodiment is therefore different, compared to the finger loops (135, 140, 145) in FIG. 1, which extend longitudinally from the palm strips. In the embodiment of FIG. 3, the gripping side of the fingers is inserted touching the palm strips. In FIG. 3, a central stitching or gluing line can be seen, where the material is joined together. Generally, the opposite side will not have a stitching since the material is folded and joined on one side only. However, in different embodiments the material may be folded, glued, or stitched in different ways. FIG. 3 also displays an exemplary texture having raised dots, which improve gripping.

Figure 4:
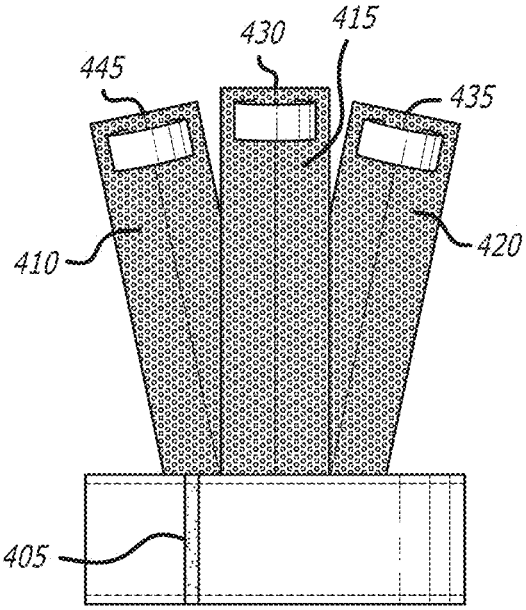
FIG. 4 illustrates the back side of exemplary glove grip strips with closed wristband.
Figure 5:
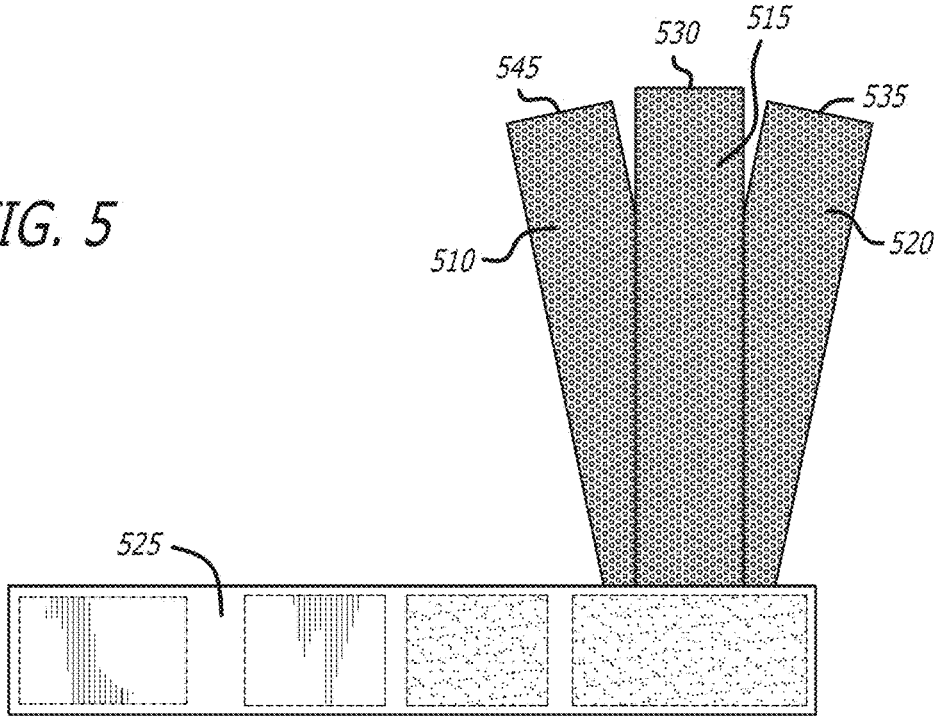
FIG. 5 illustrates the front side of an exemplary wristband configuration for a palm protector.

FIG. 4 shows an exemplary grip apparatus with the wristband in a closed position. The rough part of the Velcro® (405) may, or may not, be exposed. The finger loops (445, 430, 435) are attached on the palm strips (410, 420, 415). FIG. 5 illustrates an exemplary embodiment in which the wristband is attached at one end to the palm strips, folding the other side entirely around a wrist until the wrist band is securely locked in position. In some embodiments, the wristband will wrap around the wrist 1.5 times. In FIG. 5, the finger loops (545, 530, 535) are on the side of the palm strips (510, 520, 515) which are not visible. The wristband (525) also includes a hook and loop fastener.

Figure 6:
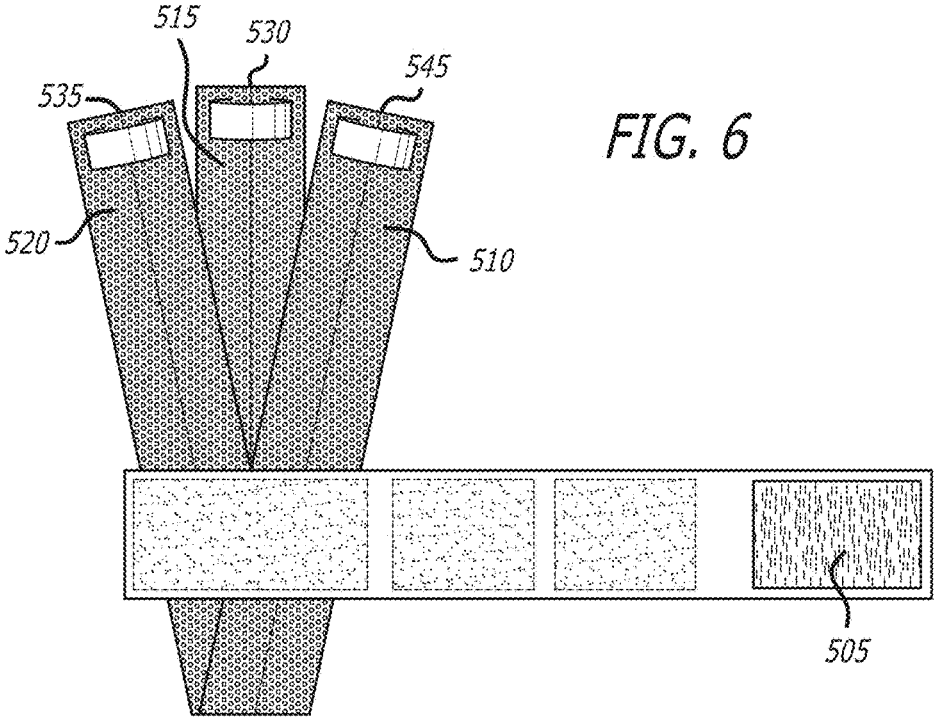
FIG. 6 illustrates a backside view of an exemplary adjustable size palm protector.

FIG. 6 illustrates another embodiment, in which the palm strips (510, 520, 515), having attached finger loops (545, 530, 535), are not permanently attached to the wristband. Instead, the wristband can be moved up or down relative to the palm strips, in order to set a desired length for the palm strips extending on the working side, that is the side with the finger loops. In this way, a single glove can be adjusted to fit multiple sizes. In some embodiments, a hook and loop fastener can be used to attach the palm strips to the wristband. The wristband will also have a hook and loop fastener (505) to fasten around a wrist.

Figure 7:
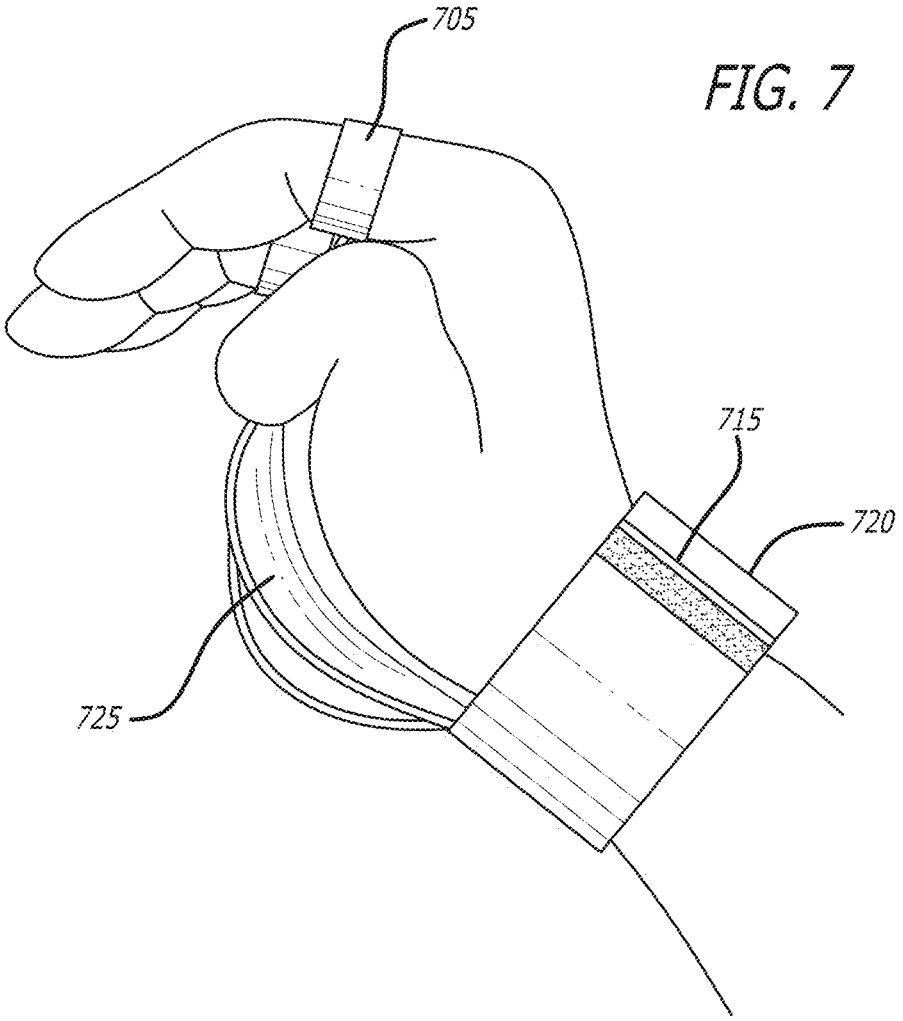
FIG. 7 illustrates a palm protector worn on a hand.

FIG. 7 illustrates an exemplary palm protector worn on a hand. The finger loops (705) are visible, and the wristband (720) may or may not have a hook and loop fastener visible (715), depending on the size adjustment needed by the user. The palm strips (725) allow free flow of air between the palm strips and the palm, when the hand is not gripping an object. This breathability allows the comfortable use of the palm protector, by eliminating excessive heat and humidity which leads to the accumulation of sweat and unpleasant microbial growth on the hands. Additionally, the elimination of the heat and humidity prevents the materials commonly used in gloves from leaving marks (from the material) on the user's hands.

In the present disclosure, a grip apparatus may also be termed a gripping glove or palm protector. The average wrist size is about 7.20 inches. Therefore, a wrist band that wraps around 1.5 times the average wrist will be about 10.8 inches.

In some embodiments, the palm strips can comprise separate strips, or the strips may be stitched together along the adjacent longitudinal sides.

The person skilled in the art will understand that in other embodiments slight modifications of the apparatus may be possible. For example, the number of palm strips and finger loops may be different from three, and may be greater or smaller.

In some embodiments, the finger loops are elastic in order to be comfortable during wear, instead of cutting into the skin like it is common in prior art embodiments. In some embodiments, the material of the gripping glove is thin, in order to be comfortable against the skin, and flexible during gripping of objects.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed, that are obvious to persons of skill in the art, are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A gripping glove, comprising:

a wrist band having a first end, a central portion, and a second end, the wrist band comprising a loop fastener patch and a hook fastener patch, wherein the wrist band is configured to wrap around a wrist of a user and secure the wrist band to the user through the hook and loop fastener patches;

a plurality of palm strips, including only a first palm strip, a second palm strip and a third palm strip, the first palm strip, having a first end and a second end, the first end being attached to the first end of the wrist band, the second palm strip, having a first end and a second end, the first end being attached to the first end of the wrist band, the third palm strip, having a first end and a second end, the first end being attached to the first end of the wrist band, and the third palm strip being joined to the first palm strip and to the second palm strip;

a first finger loop, attached to the second end of the first palm strip and configured to loop onto the index finger of the user;

a second finger loop, attached to the second end of the second palm strip and configured to loop onto the middle finger of the user; and a third finger loop, attached to the second end of the third palm strip and configured to loop onto the ring finger of the user, wherein:

the second palm strip is located between the first palm strip and the third palm strip, the first palm strip is angled laterally, over its entire length, in a first direction with respect to the second palm strip, the third palm strip is angled laterally, over its entire length, in a second direction with respect to the second palm strip, the second direction being opposite to the first direction, each of the first, second and third palm strips is configured to extend from the base of a palm of the user to the first knuckle of the respective index, middle and ring fingers of the user, and each of the first, second and third finger loops is configured to be positioned below the first knuckle of the respective finger and against the palm.

2. The gripping glove of claim 1, wherein the wrist band and/or the palm strips are made of split grain leather, polyvinyl chloride, polyurethane, nylon or neoprene.

3. The gripping glove of claim 1, wherein:

the first palm strip is folded in at both its longitudinal sides and said folded longitudinal sides are held in place by glue or adhesives;

the second palm strip is folded in at both its longitudinal sides and said folded longitudinal sides are held in place by glue or adhesives; and the third palm strip is folded in at both its longitudinal sides and said folded longitudinal sides are held in place by glue or adhesives.

4. The gripping glove of claim 1, wherein the first, second and third finger loops each extend laterally from their respective palm strips.

5. The gripping glove of claim 1, wherein the first, second and third palm strips are attached to the wrist band by stitching.

6. The gripping glove of claim 1, wherein the first, second and third palm strips are attached to the wrist band by gluing.

7. The gripping glove of claim 1, wherein the wrist band is at least 10.8 inches long.

8. The gripping glove of claim 1, wherein the wrist band is long enough to wrap 1.5 times around the wrist of the user.

9. The gripping glove of claim 1, wherein the first, second and third palm strips are configured to allow free flow of air on a palm of the user when the palm is not gripping an object.

10. A gripping glove, comprising:

a wrist band having a first end, a central portion, and a second end, the wrist band comprising a loop fastener patch and a hook fastener patch, wherein the wrist band is configured to wrap around a wrist of a user and secure the wrist band to the user through the hook and loop fastener patches;

a plurality of palm strips, including only a first palm strip, a second palm strip and a third palm strip, the first palm strip, having a first end and a second end, the first end of the first palm strip converging at the first end of the wrist band, the second palm strip, having a first end and a second end, the first end of the second palm strip converging at the first end of the wrist band, and the third palm strip, having a first end and a second end, the first end of the third palm strip converging at the first end of the wrist band;

a first finger loop, attached to the second end of the first palm strip and configured to loop onto the index finger of the user;

a second finger loop, attached to the second end of the second palm strip and configured to loop onto the middle finger of the user; and a third finger loop, attached to the second end of the third palm strip and configured to loop onto the ring finger of the user, wherein the second palm strip is located between the first palm strip and the third palm strip, the first palm strip is angled laterally, over its entire length, in a first direction with respect to the second palm strip, the third palm strip is angled laterally, over its entire length, in a second direction with respect to the second palm strip, the second direction being opposite to the first direction, each of the first, second and third palm strips is configured to extend from the base of a palm of the user to the first knuckle of the respective index, middle and ring fingers of the user, each of the first, second and third finger loops is configured to be positioned below the first knuckle of the respective finger and against the palm, and the first, second and third palm strips are not permanently attached to the wristband and are configured to move relative to the wristband to set a desired length for the palm strips.

11. The gripping glove of claim 10, wherein the first, second and third palm strips, and the wrist band comprise hook and loop fasteners configured to adjust a longitudinal length of the first, second and third palm strips with respect to the wrist band.

12. The gripping glove of claim 1, wherein the first palm strip and the third palm strip are located anterior to the second palm strip.

13. The gripping glove according to claim 1, wherein each of the first, second and third palm strips has a textured surface.

14. The gripping glove according to claim 13, wherein the textured surface comprises a plurality of dots or circles.

15. The gripping glove of claim 10, wherein the first, second and third palm strips are configured to have an adjustable length with respect to the wrist band.

16. The gripping glove of claim 10, wherein the first, second and third palm strips each are attached to the wrist band by a hook and loop fastener.

17. The gripping glove of claim 10, wherein the first, second and third finger loops each extend laterally from their respective palm strips.

18. The gripping glove of claim 10, wherein the first, second and third palm strips allow free flow of air on a palm of the user when the palm is not gripping an object.

19. The gripping glove of claim 10, wherein:

the first palm strip is folded in at both its longitudinal sides and said folded longitudinal sides are held in place by glue or adhesives;

the second palm strip is folded in at both its longitudinal sides and said folded longitudinal sides are held in place by glue or adhesives; and the third palm strip is folded in at both its longitudinal sides and said folded longitudinal sides are held in place by glue or adhesives.

20. The gripping glove of claim 10, wherein the first palm strip and the third palm strip are located anterior to the second palm strip.

21. The gripping glove according to claim 10, wherein each of the first, second and third palm strips has a textured surface.

22. The gripping glove according to claim 21, wherein the textured surface comprises a plurality of dots or circles.

* * * * *